US010911849B2

(12) United States Patent
Ivey

(10) Patent No.: US 10,911,849 B2
(45) Date of Patent: Feb. 2, 2021

(54) DIRECT FIRE SMALL CEILING SPEAKER SYSTEM

(71) Applicant: Mitek Corp., Inc., Phoenix, AZ (US)

(72) Inventor: Johnathan Ivey, Chandler, AZ (US)

( * ) Notice: Subject to any disclaimer, the term of this patent is extended or adjusted under 35 U.S.C. 154(b) by 139 days.

(21) Appl. No.: 16/129,175

(22) Filed: Sep. 12, 2018

(65) Prior Publication Data

US 2019/0090038 A1 Mar. 21, 2019

Related U.S. Application Data

(63) Continuation-in-part of application No. 15/710,654, filed on Sep. 20, 2017, now Pat. No. 10,237,636.

(51) Int. Cl.

| | |
|---|---|
| ***H04R 1/02*** | (2006.01) |
| ***H04R 31/00*** | (2006.01) |
| ***H04R 1/34*** | (2006.01) |
| ***H04R 27/00*** | (2006.01) |

(52) U.S. Cl.

CPC ..... *H04R 1/023* (2013.01); *H04R 1/345* (2013.01); *H04R 27/00* (2013.01); *H04R 31/006* (2013.01); *H04R 2201/021* (2013.01); *H04R 2201/029* (2013.01)

(58) Field of Classification Search

CPC ..... H04R 1/02

See application file for complete search history.

(56) References Cited

U.S. PATENT DOCUMENTS

| | | | | |
|---|---|---|---|---|
| 4,908,601 | A * | 3/1990 | Howze | G08B 3/00 181/144 |
| 5,673,329 | A * | 9/1997 | Wiener | H04R 1/34 181/144 |
| 5,847,331 | A * | 12/1998 | Vollmer | H04R 1/345 181/147 |
| 6,215,885 | B1 * | 4/2001 | Geiger | H04R 1/023 181/224 |
| 6,574,344 | B1 * | 6/2003 | Wiener | H04R 1/345 181/152 |
| 8,620,016 | B2 | 12/2013 | Belanger et al. | |
| 2004/0213429 | A1 * | 10/2004 | Seidler | H04R 1/025 381/386 |
| 2006/0177088 | A1 * | 8/2006 | Howard | H04R 1/023 381/391 |
| 2009/0028372 | A1 * | 1/2009 | Cerasuolo | F21V 33/0052 381/387 |
| 2011/0019862 | A1 * | 1/2011 | Smith | H04R 1/26 381/386 |
| 2013/0058518 | A1 * | 3/2013 | Held | G10K 9/00 381/386 |

* cited by examiner

*Primary Examiner* — Olisa Anwah
(74) *Attorney, Agent, or Firm* — Keith L. Jenkins, Registered Patent Attorney LLC; Keith L. Jenkins

(57) ABSTRACT

An attachment to a small ceiling speaker system that is interchangeable with a diffuser of such system and that provides direct downward direction to sound produced by such system. A director interface is provided for adjustably attaching to an acoustic channel shell of such system. A direct fire ring releasably attaches to the director interface with a fastener. The direct fire ring supports magnets for releasably attaching a foraminous audio speaker grill. The director interface and the direct fire ring have alignable hub and spoke features and the hub and spokes of the director interface partially nest within the hub and spokes of the direct fire ring.

20 Claims, 5 Drawing Sheets

DIRECT FIRE SMALL CEILING SPEAKER SYSTEM

RELATIONSHIP TO OTHER APPLICATIONS

The present application is a continuation-in-part of U.S. patent application Ser. No. 15/710,654 filed Sep. 20, 2017 by the same inventor.

FIELD OF ART

The present invention relates to ceiling mounted loudspeakers having a small form factor and direct sound delivery. The present invention more particularly relates to a small speaker system with a director that can adjust over a range of thicknesses of ceiling tiles and can be used interchangeably with the diffuser of the Small Ceiling Speaker System of U.S. patent application Ser. No. 15/710,654.

BACKGROUND OF THE INVENTION

Ceiling speakers are used in suspended ceilings, typically for public address, alarm, or musical entertainment purposes. Many ceiling speakers are designed for predetermined thicknesses of ceiling tile. Many ceiling speakers also load the ceiling tile which can cause deformation or failure of the tile over time. Direct fire speakers are useful in sound masking applications.

SUMMARY OF THE INVENTION

Briefly described, the invention includes an interchangeable part for applicant's previously filed small ceiling speaker system US patent application that provides direct downward projection of sound ("direct fire") from a small ceiling speaker with a variable adjustable length sound director that is adjustable over a range of ceiling tile thicknesses. The portion of the small ceiling speaker that is above the ceiling tile is preferably supported in an enclosure that is supported directly by the grid of ceiling tile supports, and not on the tiles per se. The portion of the small ceiling speaker that is below the ceiling tile is small. The sound director includes a flanged cylindrical shell body for adjustably coupling to the acoustic channel shell of the Small Ceiling Speaker System of U.S. patent application Ser. No. 15/710,654, a direct fire ring, a magnetically attachable and releasable grill, and appropriate couplings.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

Figure 8:
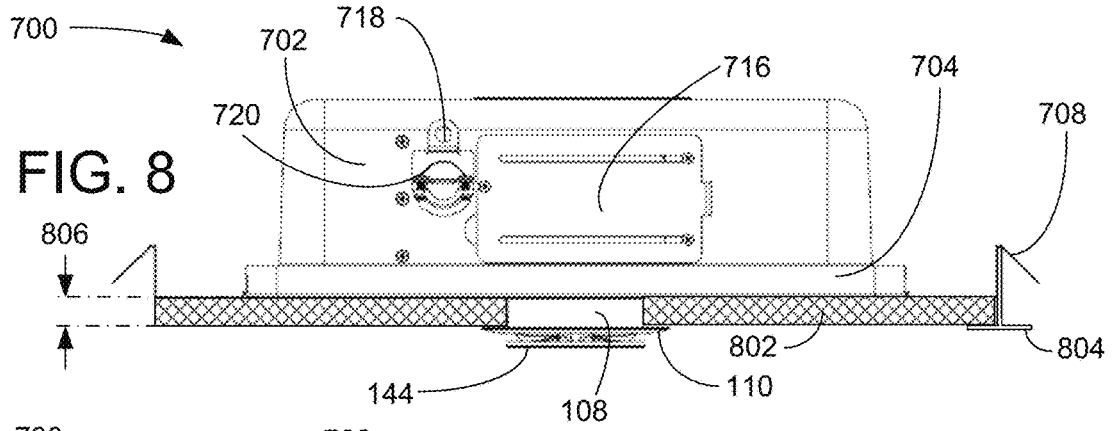
FIG. 8 is a side elevation view illustrating the exemplary embodiment of the direct fire small ceiling speaker system of FIG. 7, according to a preferred embodiment of the present invention.
Figure 10:
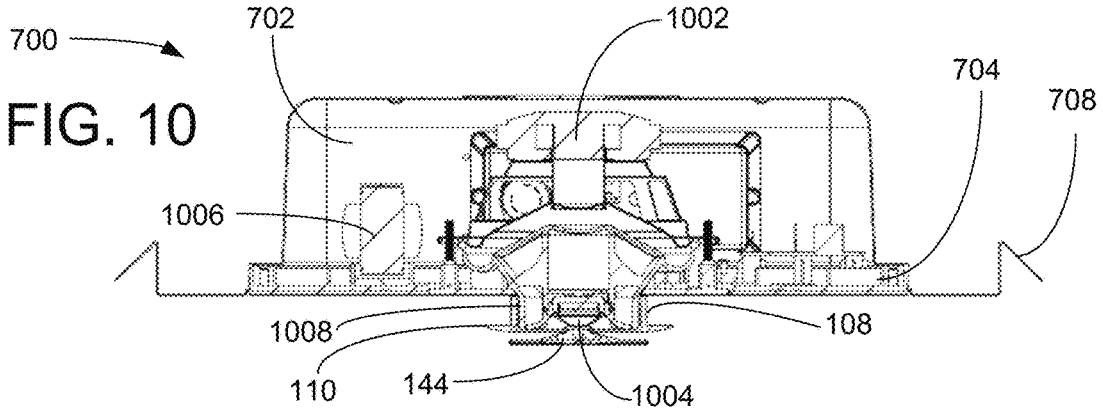
FIG. 10 is a cross sectional elevation view through cross section BB illustrating the exemplary embodiment of the direct fire small ceiling speaker system of FIG. 1 and FIG. 7, according to a preferred embodiment of the present invention.

As used and defined herein, "top", "bottom", "upper", "lower", "upward", and "downward" are referenced to the present invention in its installed orientation, as illustrated in FIG. 8 and FIG. 10. As used and defined herein, "speaker" means "loudspeaker" or "tweeter", as shown in FIG. 10. As used and defined herein, "director", without more, means an acoustic director for projecting sound. The claims below contain functional claim language and do not contain any statements of intended use.

The specification and drawings of the Small Ceiling Speaker System of U.S. patent application Ser. No. 15/710,654 is hereby incorporated herein in its entirety.

Figure 1:
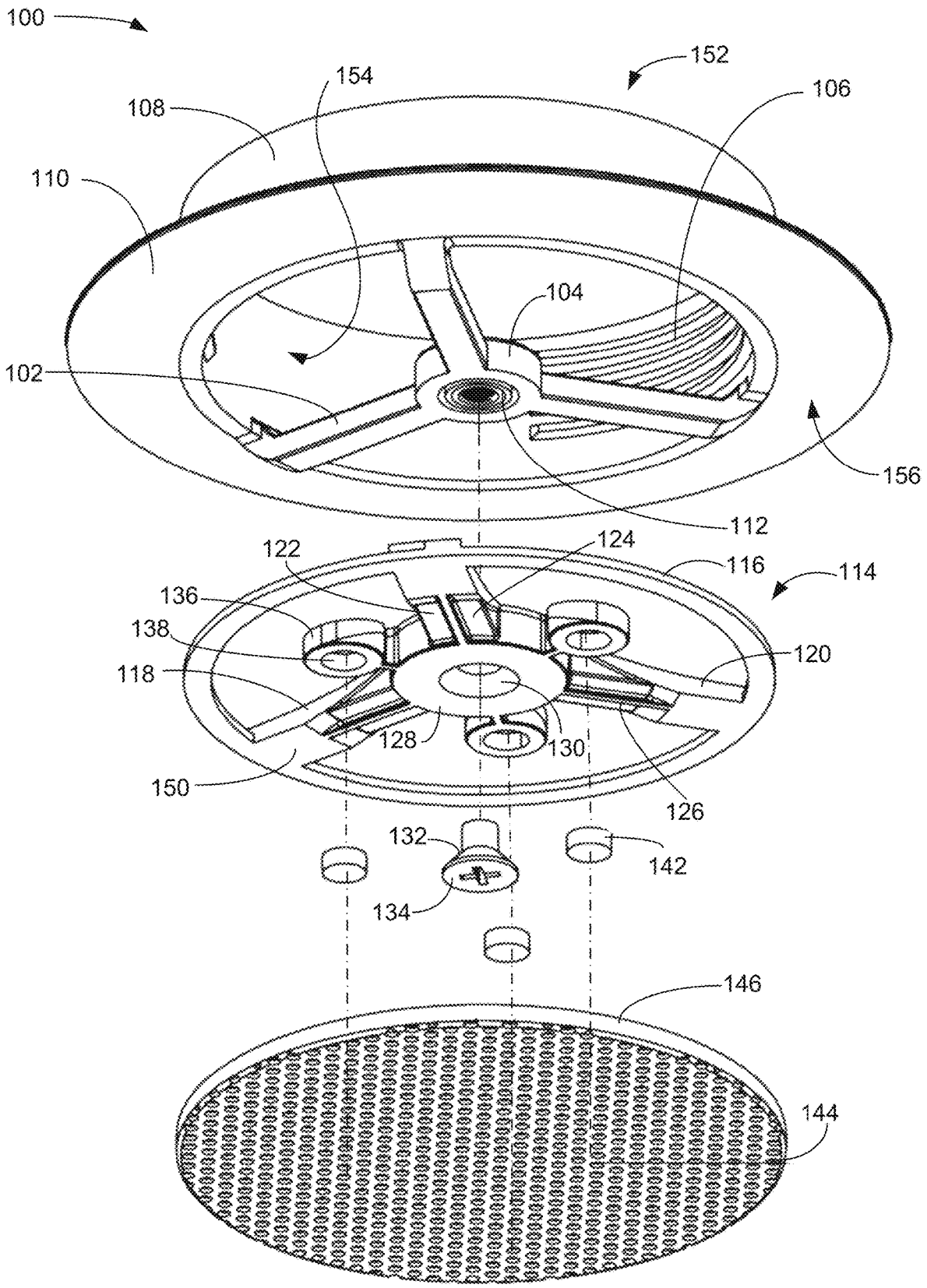
FIG. 1 is a side-bottom perspective exploded view illustrating an exemplary embodiment of the director of the direct fire small ceiling speaker system, according to a preferred embodiment of the present invention.

FIG. 1 is a side-bottom perspective exploded view illustrating an exemplary embodiment of the director 100 of direct fire small ceiling speaker system 700 (see FIG. 7), according to a preferred embodiment of the present invention. The director interface 152 has a cylindrical shell body 108 with partial sectional threads 106 (one visible set of two opposing sets labeled) on an internal surface 154 of the cylindrical shell body 108, an annular flange 110 extending radially from a bottom external portion of the cylindrical shell body 108, and three spokes 102 (one of three labeled) extending from a bottom interior portion of the cylindrical shell body 108. Annular flange 110 has a radially arcuate lower surface 156. Spokes 102 have predetermined cross sections, illustrated here as rectangular, and meet at a common hub 104. In various other embodiments, respective other cross-sectional shapes may be used for spokes 102. Spokes 102 extend below annular flange 110. Hub 104 has a threaded fastener receiver 112 for receiving the threaded end of threaded fastener 132, illustrated here as screw 132. Partial sectional threads 106 are for adjusting the distance between the flange 110 and the bottom panel 706 (see FIG. 7), to adapt to different thicknesses of ceiling tile. Director interface 152 is similar to the cylindrical portion of the diffuser of U.S. patent application Ser. No. 15/710,654 and, in a preferred embodiment, are interchangeable. The illustrated pattern of spokes 102 is merely exemplary: in various embodiments, other patterns and numbers of spokes 102 may be used. Preferably, the director interface 152 is of one piece.

Direct fire ring 114 has an annular frame 116 and three direct fire ring spokes 150 (one of three labeled) extending radially inward from the direct fire ring 114 to join ring hub 128. Each direct fire ring spoke 150 has a left side 118 (looking radially outward, one of three labeled) and a right side 120 (looking radially outward, one of three labeled) that will define a channel 302 (See FIG. 3) for receiving portions of spokes 102 (one of three labeled). Channel bottom section undersides 122 and 124 (one of three of each labeled) are divided by a vertical support flange 126 (one of three labeled). Ring hub 128 has a beveled fastener receiver 130 for receiving the head of fastener 134, illustrated as a countersink screw 134, for attaching the direct fire ring 114 to the director interface 152. Ring hub 128 also supports three magnet cups 136 (one of three labeled), each having a cavity 138 for receiving and retaining a magnet 142 (one of three labeled). Direct fire ring 114 is preferably of one piece. In various embodiments, direct fire ring 114 may have more or fewer spokes 150 in respective various configurations, corresponding to the number and configuration of spokes 102.

Audio speaker grill 144 is foraminous and magnetically attachable and releasable using magnets 142 (one of three labeled). Audio speaker grill 144 has an upwardly extending rim 146 that fits around annular frame 116 of direct fire ring 114 during assembly.

Figure 2:
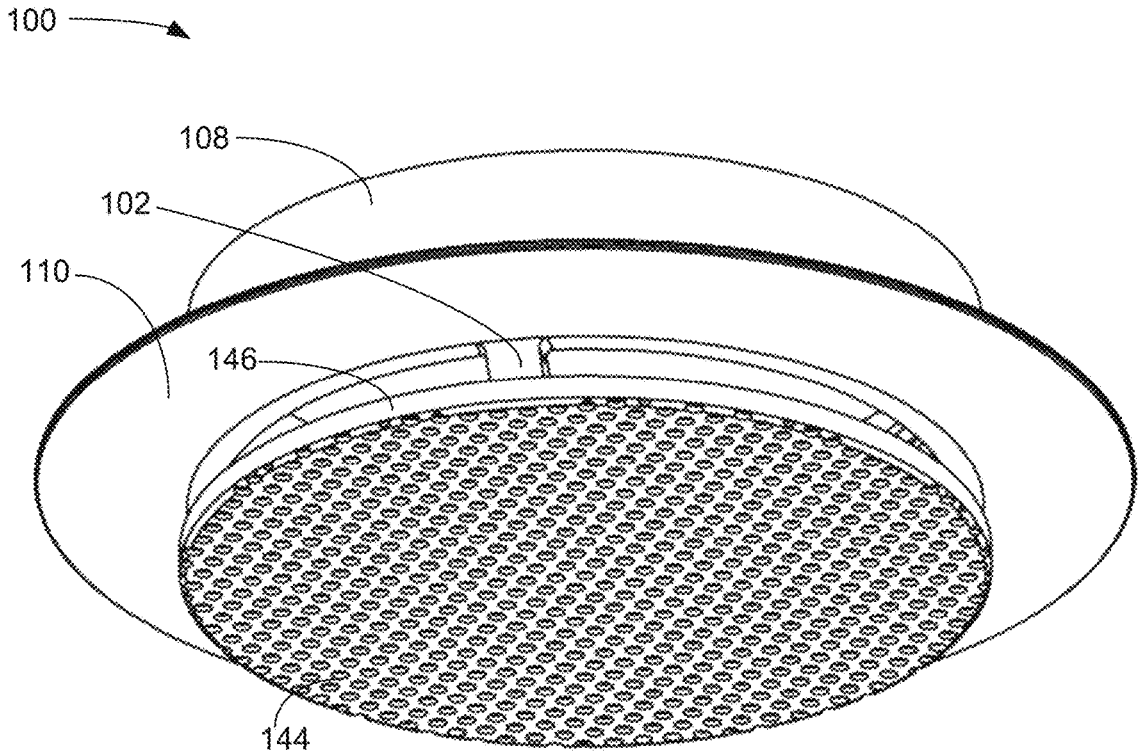
FIG. 2 is a bottom perspective view illustrating the exemplary embodiment of the director of FIG. 1 of the direct fire small ceiling speaker system of FIG. 7, according to a preferred embodiment of the present invention.
Figure 7:
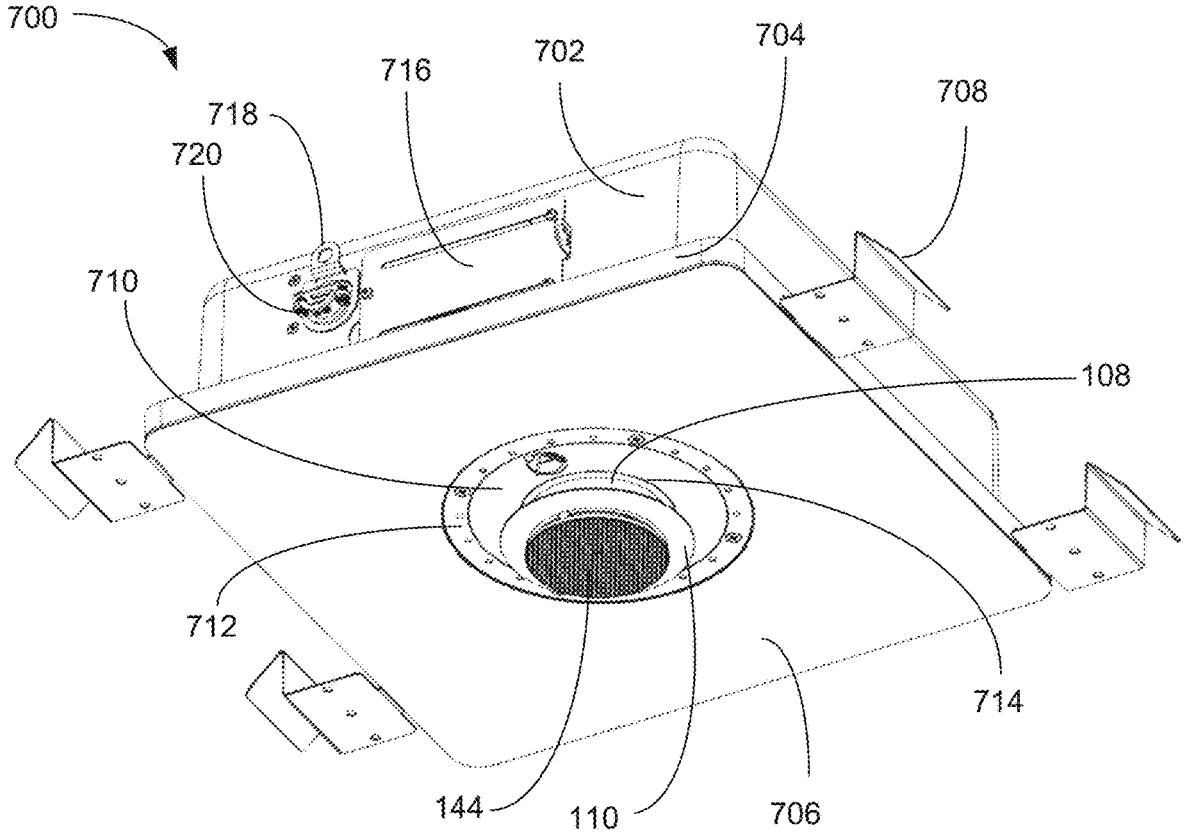
FIG. 7 is a bottom perspective view illustrating the exemplary embodiment of the director 100 of FIG. 1 installed in a small ceiling speaker system of U.S. patent application Ser. No. 15/710,654 to form the direct fire small ceiling speaker system, according to a preferred embodiment of the present invention.

FIG. 2 is a bottom perspective view illustrating the exemplary embodiment of the director 100 of FIG. 1 of the direct fire small ceiling speaker system 700 of FIG. 7, according to a preferred embodiment of the present invention. In this assembled configuration, director 100 can be attached to acoustic channel shell 1008 (see FIG. 10) of the remainder of the direct fire small ceiling speaker system 700 (see FIG. 7). When installed, acoustic channel shell 1008 (see FIG. 10) extends through an opening 714 (see FIG. 7) in a bottom panel 706 and through an opening in a ceiling tile 802 (see FIG. 8) to threadingly engage the a cylindrical shell body 108 of the direct fire small ceiling speaker system 700 (see FIG. 7).

Figure 3:
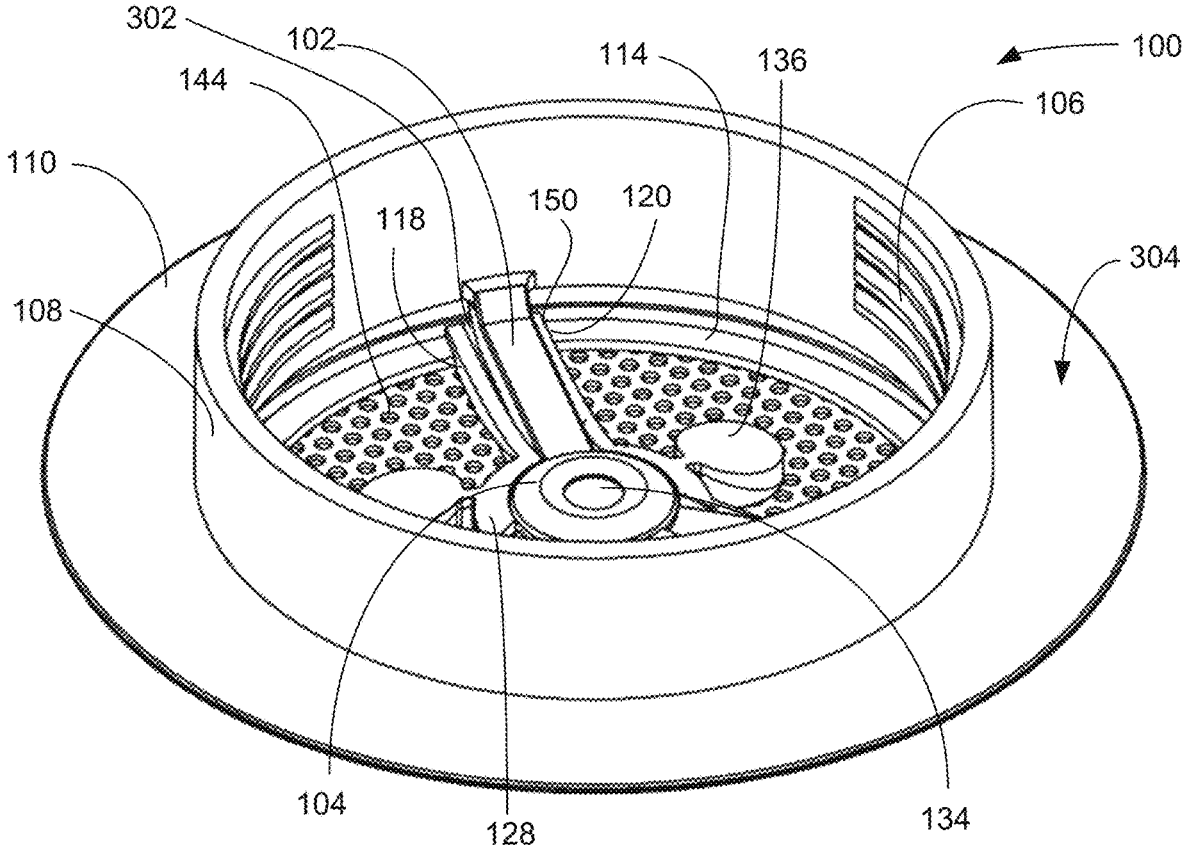
FIG. 3 is a top perspective view illustrating the exemplary embodiment of the director of FIG. 1 of the direct fire small ceiling speaker system of FIG. 7, according to a preferred embodiment of the present invention.

FIG. 3 is a top perspective view illustrating the exemplary embodiment of the director 100 of the direct fire small ceiling speaker system of FIG. 7, according to a preferred embodiment of the present invention. A lower portion of spoke 120 of the director interface 152 is within a channel 302 formed between left 118 and right 120 sides of direct fire ring spoke 150. Direct fire ring spokes 150 are alignable to spokes 102 in any configuration. The end of fastener 134 is visible in hub 104 which is aligned with ring hub 128. Annular flange 104 has a flat top surface 304.

Figure 4:
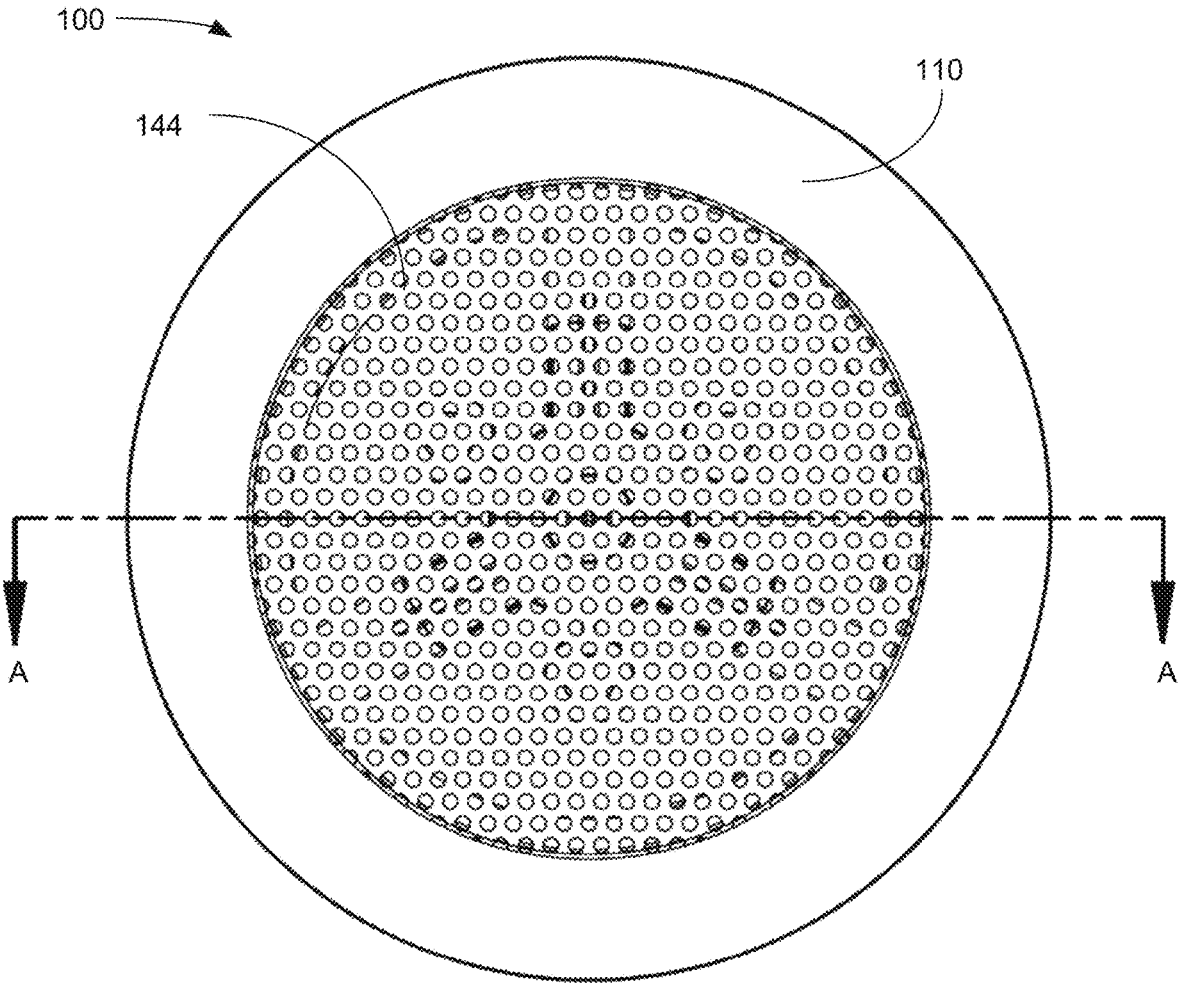
FIG. 4 is a bottom plan view illustrating the exemplary embodiment of the director of FIG. 1 of the direct fire small ceiling speaker system of FIG. 7 and defining cross section AA, according to a preferred embodiment of the present invention.

FIG. 4 is a bottom plan view illustrating the exemplary embodiment of the director 100 of FIG. 1 of the direct fire small ceiling speaker system 700 of FIG. 7 and defining cross section AA, according to a preferred embodiment of the present invention. Foraminous audio speaker grill 144 is releasably attached to the direct fire ring 114 by magnets 142. Cross section AA does not pass through the magnet cups 136.

Figure 5:
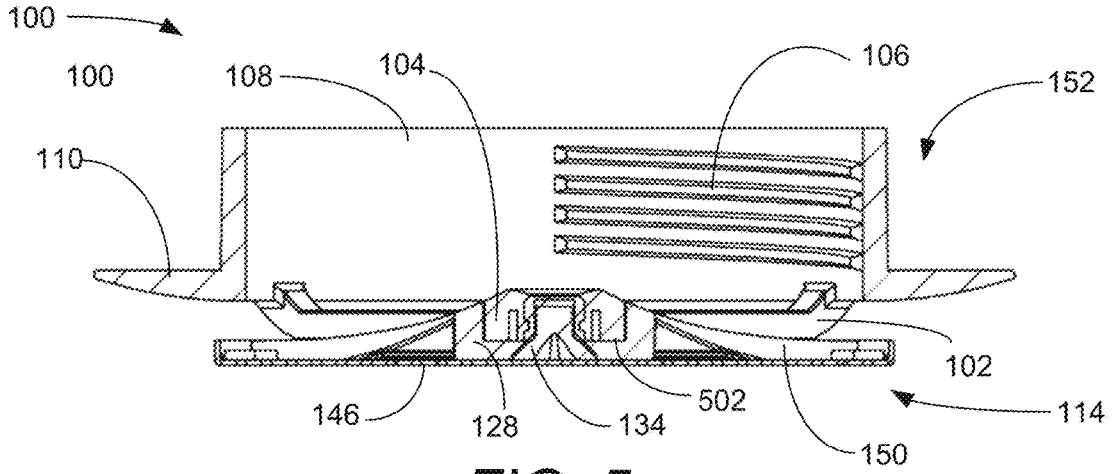
FIG. 5 is a side cross sectional view through cross section AA illustrating the exemplary embodiment of the director of FIG. 1 of the direct fire small ceiling speaker system of FIG. 7, according to a preferred embodiment of the present invention.

FIG. 5 is a side cross sectional view through cross section AA illustrating the exemplary embodiment of the director 100 of FIG. 1 of the direct fire small ceiling speaker system 700 of FIG. 7, according to a preferred embodiment of the present invention. The partial nesting of spokes 102 within direct fire ring spokes 150 is visible in this view. Fastener 134 extends through ring hub 128 and threads into hub 104 to fasten direct fire ring 114 to director interface 152. Center hub 128 partially nests within a cavity 502 in the top of fire ring hub 128, as shown.

Figure 6:
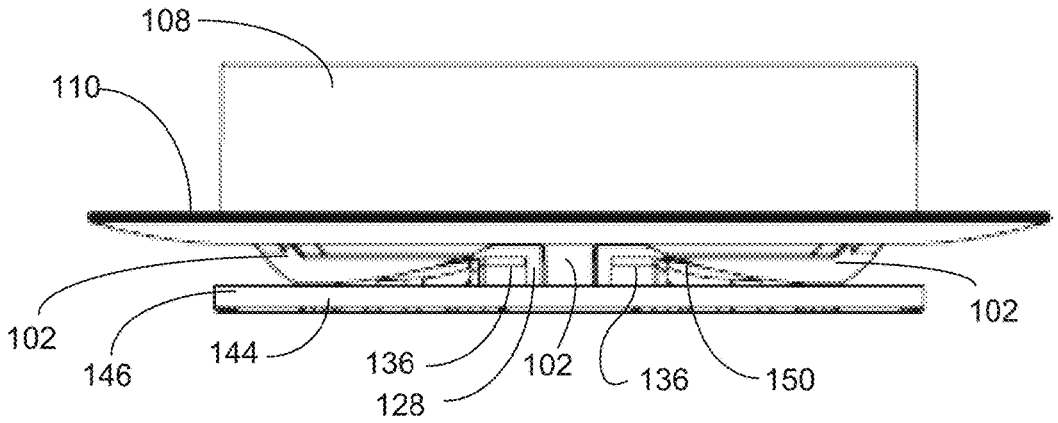
FIG. 6 is a side elevation view illustrating the exemplary embodiment of the director of FIG. 1 the direct fire small ceiling speaker system of FIG. 7, according to a preferred embodiment of the present invention.

FIG. 6 is a side elevation view illustrating the exemplary embodiment of the director 100 of FIG. 1 of the direct fire small ceiling speaker system 700 of FIG. 7, according to a preferred embodiment of the present invention. Two magnet cups 136 are visible in this view. Magnets 142 may be installed in magnet cups 136 by adhesion or similarly effective means.

FIG. 7 is a bottom perspective view illustrating the exemplary embodiment of the director 100 of FIG. 1 installed in a small ceiling speaker system of U.S. patent application Ser. No. 15/710,654 to form the direct fire small ceiling speaker system 700, according to a preferred embodiment of the present invention. The director 100 is preferably interchangeable with the diffuser of U.S. patent application Ser. No. 15/710,654. Enclosure 702 houses a speaker 1002 (see FIG. 10), a tweeter 1004 (see FIG. 10), and associated electronics 1006 (see FIG. 10). Enclosure 702 features an access panel 716, a strain relief 718, electrical connectors 720, and a rim 704. Bottom panel 706 is secured within rim 704 and provides a carrier 710 for the speakers 1002 and 1004 that is fastened to the bottom panel 706 using fastener ring 712. Opening 714 in carrier 710 admits the acoustic channel shell 1008 (see FIG. 10) to be threadingly attached to the cylindrical shell body 108. Enclosure 702 has four independently extendable braces 708 (one of four labeled) to support the enclosure 702 on the ceiling tile supports 804 (See FIG. 8), rather than on the ceiling tile 802 (see FIG. 8) itself.

FIG. 8 is a side elevation view illustrating the exemplary embodiment of the direct fire small ceiling speaker system 700 of FIG. 7, according to a preferred embodiment of the present invention. The four independently extendable braces 708 (one of four labeled). support the enclosure 702 on the ceiling tile supports 804, rather than on the ceiling tile 802 itself. Director 100 can be sliding and them threadably adjusted to accommodate ceiling tiles 802 of various thicknesses 806. Ceiling tile support 804 is shown with independently extendable brace 708 engaged.

Figure 9:
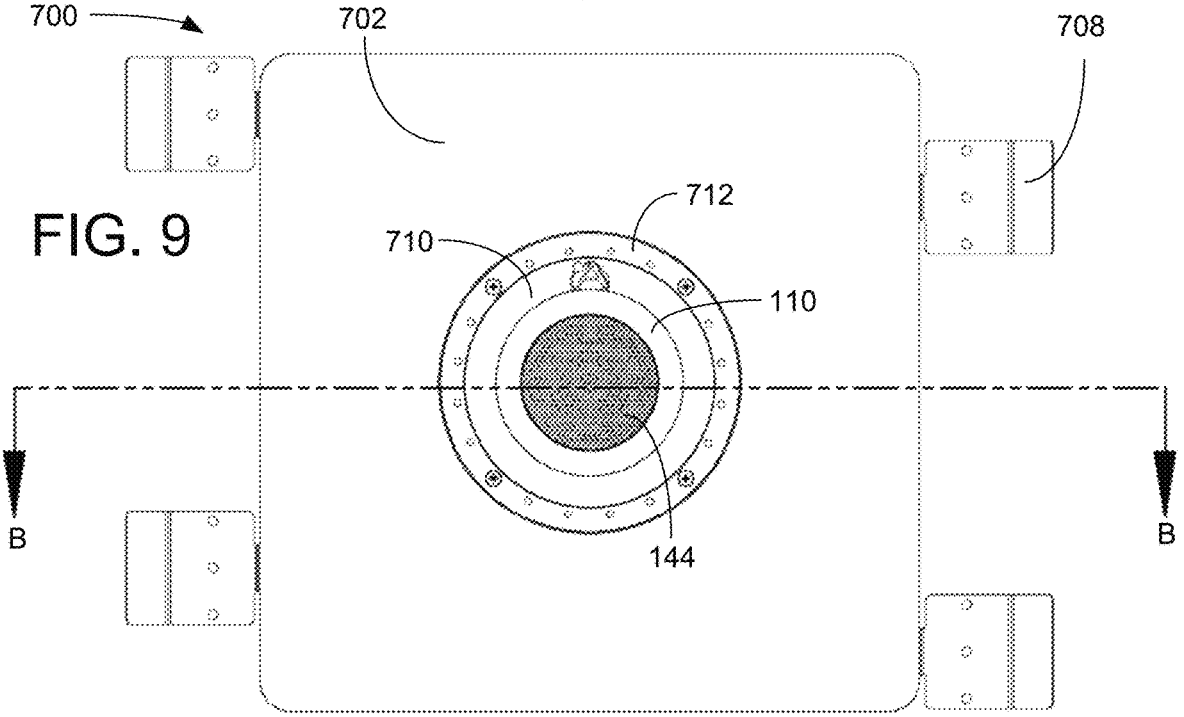
FIG. 9 is a bottom plan view illustrating the exemplary embodiment of the direct fire small ceiling speaker system of FIG. 7 and defining a cross section BB, according to a preferred embodiment of the present invention.

FIG. 9 is a bottom plan view illustrating the exemplary embodiment of the direct fire small ceiling speaker system 700 of FIG. 7 and defining a cross section BB, according to a preferred embodiment of the present invention. When installed in a ceiling, only audio speaker grill 144 and flange 110 would be visible in this view.

FIG. 10 is a cross sectional elevation view through cross section BB illustrating the exemplary embodiment of the direct fire small ceiling speaker system 700 of FIG. 7, according to a preferred embodiment of the present invention. Speaker 1002 is shown in a downward-pointed orientation, as is tweeter 1004. Cylindrical shell body 108 can be seen threadingly engaged with acoustic channel shell 1008. Associated electronics within enclosure 702 are not limited to transformer 1006, which may have selectable multiple taps.

Points of novelty for this invention include interchangeability of the director 100 with the diffuser of a preexisting system, the direct fire ring 114, the partially nesting hubs 104 and 128, and the partially nesting spokes 102 and 150. Director 100 produces a small acoustic footprint, which is a further advantage, and so enables the use of one design of small ceiling speaker system for both diffuse and directed sound systems.

The claims below contain functional claims and do not include any statements of intended purpose.

I claim:

1. A direct fire small ceiling speaker system comprising:

a. an enclosed small ceiling speaker system operable to project sound through a partially threaded acoustic channel shell; and b. a director adjustably and threadedly engageable to said partially threaded acoustic channel shell and operable, when so engaged, to direct said projected sound downward, wherein i. said director comprises:

1. i. a director interface;

2. ii. a direct fire ring attachable to said director interface; and 3. iii. an audio speaker grill releasably attachable to said direct fire ring; and ii. said director interface comprises:

1. a cylindrical shell body;

2. a flange extending radially outward from a bottom end portion of said cylindrical shell body;

3. a plurality of spokes extending radially inward from a bottom portion of said cylindrical shell body to a central hub; and 4. a threaded fastener receiver in said central hub.

2. The system of claim 1, wherein said enclosed small ceiling speaker system comprises an enclosure comprising four independently extendable braces.

3. The system of claim 1, comprising a fastener for fastening said direct fire ring to said director interface.

4. The system of claim 2, wherein said four independently extendable braces are configured to support the enclosure on at least two ceiling tile supports.

5. The system of claim 1, wherein said cylindrical shell body comprises first and second opposed sections of threads on an internal surface of said cylindrical shell body.

6. The system of claim 1, wherein said flange has a flat upper surface and a radially arcuate bottom surface.

7. The system of claim 1, wherein each spoke of said plurality of spokes:

a. has a predetermined cross-sectional shape; and b. extends below said flange.

8. The system of claim 1, wherein said direct fire ring comprises:

a. an annular frame;

b. a plurality of direct fire ring spokes extending radially inward from said annular frame to a fire ring hub; and c. a beveled fastener receiver in said fire ring hub.

9. The system of claim 8, wherein each direct fire ring spoke of said plurality of direct fire ring spokes comprises:

a. a radial channel configured to receive at least a portion of a respective spoke of said plurality of spokes of said director interface; and b. an orientation alignable to a respective spoke of said plurality of spokes of said director interface.

10. The system of claim 8, comprising:

a. a plurality of magnet cups extending from said fire ring hub; and b. a cavity in a top of said fire ring hub configured to receive at least a portion of said central hub.

11. The system of claim 1, wherein said audio speaker grill comprises:

a. a circular foraminous panel; and b. a rim extending upward from a perimeter of said circular foraminous panel.

12. The system of claim 1, wherein:

a. said director interface is of one piece;

b. said fire ring hub is of one piece; and c. said grill is of one piece.

13. A direct fire small ceiling speaker system comprising:

a. an enclosed small ceiling speaker system operable to project sound through a partially threaded acoustic channel shell; and b. a director adjustably engageable to said partially threaded acoustic channel shell and operable, when so engaged, to direct said projected sound downward;

c. wherein said director comprises:

i. a director interface;

ii. a direct fire ring attachable to said director interface, iii. comprising an annular frame and a plurality of fire ring spokes extending radially inward from said annular frame to a central hub;

iv. a radial channel in the upwardly-facing portion of each said fire ring spoke of said plurality of fire ring spokes;

v. an audio speaker grill releasably attachable to said direct fire ring;

vi. a fastener for fastening said direct fire ring to said director interface; and vii. at least one magnet supported in said direct fire ring operable to releasably attach said audio speaker grill to said direct fire ring; and d. wherein said director interface comprises:

i. a cylindrical shell body;

ii. a flange extending radially outward from a bottom end portion of said cylindrical shell body;

iii. a plurality of director interface spokes extending radially inward from a bottom portion of said cylindrical shell body to a central hub; and iv. a threaded fastener receiver in said central hub;

v. wherein said director interface spokes are configured to partially nest in said fire ring spokes.

14. The system of claim 13, wherein:

a. said enclosed small ceiling speaker system comprises an enclosure comprising four independently extendable braces; and b. said four independently extendable braces are configured to support the enclosure on at least two ceiling tile supports.

15. The system of claim 13, wherein:

a. said cylindrical shell body comprises first and second opposed sections of threads on an internal surface of said cylindrical shell body;

b. said flange has a flat upper surface and a radially arcuate bottom surface;

c. each spoke of said plurality of spokes:

i. has a predetermined cross-sectional shape; and ii. extends below said flange.

16. The system of claim 13, wherein said direct fire ring comprises:

a. a beveled fastener receiver in said fire ring hub;

b. a plurality of magnet cups extending from said fire ring hub; and c. a cavity in a top of said fire ring hub configured to receive at least a portion of said central hub.

17. The system of claim 13, wherein said audio speaker grill comprises:

a. a circular foraminous panel; and b. a rim extending upward from a perimeter of said circular foraminous panel.

18. The system of claim 13, wherein:

a. said director interface is of one piece;

b. said fire ring hub is of one piece; and c. said grill is of one piece.

19. A direct fire small ceiling speaker system comprising:

a. an enclosed small ceiling speaker system operable to project sound through a partially threaded acoustic channel shell; and b. a director adjustably engageable to said partially threaded acoustic channel shell and operable, when so engaged, to direct said projected sound downward; and c. wherein said director comprises:

i. a director interface;

ii. a direct fire ring attachable to said director interface;

iii. an audio speaker grill releasably attachable to said direct fire ring;

iv. a fastener for fastening said direct fire ring to said director interface; and v. at least one magnet supported in said direct fire ring operable to releasably attach said audio speaker grill to said direct fire ring;

d. wherein said director interface comprises:

i. a cylindrical shell body;

ii. a flange extending radially outward from a bottom end portion of said cylindrical shell body;

iii. a plurality of spokes extending radially inward from a bottom portion of said cylindrical shell body to a central hub;

iv. a threaded fastener receiver in said central hub;

v. wherein:

1. said cylindrical shell body comprises first and second opposed sections of threads on an internal surface of said cylindrical shell body;

2. said flange has a flat upper surface and a radially arcuate bottom surface; and 3. each spoke of said plurality of spokes:

a. has a predetermined cross-sectional shape; and b. extends below said flange; and vi. said director interface is of one piece; and e. wherein said direct fire ring comprises:

i. an annular frame;

ii. a plurality of direct fire ring spokes extending radially inward from said annular frame to a fire ring hub;

iii. a beveled fastener receiver in said fire ring hub;

iv. a plurality of magnet cups extending from said fire ring hub; and v. a cavity in a top of said fire ring hub configured to receive at least a portion of said central hub;

vi. wherein each direct fire ring spoke of said plurality of direct fire ring spokes comprises:

1. a radial channel configured to receive at least a portion of a respective spoke of said plurality of spokes of said director interface; and 2. an orientation alignable to a respective spoke of said plurality of spokes of said director interface; and vii. said fire ring hub is of one piece.

20. The system of claim 19, wherein said audio speaker grill comprises:

a. a circular foraminous panel;

b. a rim extending upward from a perimeter of said circular foraminous panel; and c. said audio speaker grill is of one piece.

* * * * *